US009962714B2

(12) United States Patent
Azpiroz et al.

(10) Patent No.: US 9,962,714 B2
(45) Date of Patent: May 8, 2018

(54) MICROCHANNEL, MICROFLUIDIC CHIP AND METHOD FOR PROCESSING MICROPARTICLES IN A FLUID FLOW

(71) Applicant: International Business Machines Corporation, Armonk, NY (US)

(72) Inventors: Jaione Tirapu Azpiroz, Rio de Janeiro (BR); Emmanuel Delamarche, Thalwil (CH); Claudius Feger, Poughkeepsie, NY (US); Yuksel Temiz, Lüssiweg (CH)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 248 days.

(21) Appl. No.: 14/797,168

(22) Filed: Jul. 12, 2015

(65) Prior Publication Data

US 2017/0008009 A1 Jan. 12, 2017

(51) Int. Cl.

| | |
|---|---|
| ***B03C 5/00*** | (2006.01) |
| ***B01L 3/00*** | (2006.01) |
| ***B03C 5/02*** | (2006.01) |

(52) U.S. Cl.

CPC ..... *B03C 5/005* (2013.01); *B01L 3/502761* (2013.01); *B03C 5/026* (2013.01); *B01L 3/502746* (2013.01); *B01L 2200/0652* (2013.01); *B01L 2200/0668* (2013.01); *B01L 2200/0684* (2013.01); *B01L 2400/0424* (2013.01); *B01L 2400/084* (2013.01); *B03C 2201/18* (2013.01); *B03C 2201/26* (2013.01)

(58) Field of Classification Search

CPC B03C 5/00; B03C 5/022; B03C 5/024; B03C 5/026; B03C 5/005; B01L 3/502761; B01L 2400/0424; B01L 2200/0652; B01L 2200/0684; B01L 2200/0668; B01L 2400/0421; F15D 1/00; G01N 27/221; G01N 27/447

See application file for complete search history.

(56) References Cited

U.S. PATENT DOCUMENTS 7,988,841 B2 * 8/2011 Scurati ..... B03C 5/026 204/547

2001/0047941 A1 12/2001 Washizu (Continued)

OTHER PUBLICATIONS

Khashayar Khoshmanesh, Dielectrophoretic Platforms for Bio-microfluidic Systems. Biosensors and Bioelectronics, vol. 26, Issue 5, Jan. 15, 2011, pp. 1800-1814, provided as pp. 1-28 downloaded from http://www.deakin.edu.au/research/cisr/docs/20111800.pdf on Jun. 23, 2015.

(Continued)

*Primary Examiner* — Gurpreet Kaur

(74) *Attorney, Agent, or Firm* — Daniel P. Morris; Otterstedt, Ellenbogen & Kammer, LLP

(57) ABSTRACT

A microchannel for processing microparticles in a fluid flow comprises a first and second pairs of electrodes. The first pair of electrodes is configured for generating an asymmetric first electric field and for sorting the microparticles to provide sorted microparticles. The second pair of electrodes is configured for generating an asymmetric second electric field and for trapping at least some of the sorted microparticles.

20 Claims, 12 Drawing Sheets

(56) References Cited

U.S. PATENT DOCUMENTS

| | | | | |
|---|---|---|---|---|
| 2003/0006140 | A1 | 1/2003 | Vacca | |
| 2004/0211669 | A1 | 6/2004 | Cummings | |
| 2005/0123930 | A1* | 6/2005 | Lean | B03C 5/028 435/6.11 |
| 2009/0092989 | A1* | 4/2009 | Chang | B03C 5/005 435/6.14 |
| 2009/0148937 | A1* | 6/2009 | Schnelle | B01L 3/502753 435/325 |
| 2010/0003666 | A1 | 1/2010 | Lee | |
| 2010/0012496 | A1 | 1/2010 | Tsunazawa et al. | |
| 2011/0045994 | A1 | 2/2011 | Voldman | |
| 2011/0226624 | A1 | 9/2011 | Dorrer | |
| 2012/0325749 | A1 | 12/2012 | Kim | |
| 2016/0367988 | A1* | 12/2016 | Azpiroz | B03C 5/005 |

OTHER PUBLICATIONS

Yuksel Temiz,Capillary-driven microfluidic chips with evaporation-induced flow control and dielectrophoretic microbead trapping. Microfluidics, BioMEMS, and Medical Microsystems XII, edited by Bonnie L. Gray, Holger Becker, Proc. of SPIE vol. 8976, 89760Y Downloaded From: http://proceedings.spiedigitallibrary.org/ on Mar. 19, 2014, pp. 1-10.

Hai-Hang Cui,Separation of particles by pulsed dielectrophoresis. Lab Chip, 2009, 9, The Royal Society of Chemistry 2009. pp. 2306-2312.

Lisen Wang,Dielectrophoresis switching with vertical sidewall electrodes for microfluidic flow cytometry. Lab Chip, 2007, 7, The Royal Society of Chemistry 2007. pp. 1114-1120.

Keith J. Morton,Hydrodynamic metamaterials: Microfabricated arrays to steer, refract, and focus streams of biomaterials. PNAS, May 27, 2008 , vol. 105 , No. 21. pp. 7434-7438.

David J. Collins,Particle separation using virtual deterministic lateral displacement (vDLD). Lab Chip, The Royal Society of Chemistry 2014 014, 14, pp. 1595-1603, Published on Feb. 28, 2014.

Dino Di Carlo, et al., Dynamic single cell culture array, Lab Chip 2006, 6, pp. 1445-1449, The Royal Society of Chemistry 2006, First published as an Advance Article on the web Sep. 4, 2006.

Ryan D. Sochol, et al., Hydrodynamic resettability for a microfluidic particulate-based arraying system, Lab Chip, The Royal Society of Chemistry 2012, 12, pp. 5051-5056, Published on Sep. 17, 2012.

Jaione Tirapu Azpiroz et al., unpublished U.S. Appl. No. 14/797,170 filed Jul. 12, 2015, pp. 1-30.

List of IBM Patents or Patent Applications Treated as Related.

Drag Coefficient (Nakayama, Y. Boucher, R.F .. (2000). Introduction to Fluid Mechanics (Butterworth-Heineman Edition)—9.3.3 The Drag of Sphere, p. 156. Elsevier. http://app.knovel.com/hotlink/pdf/id:kto03VLGU1/introduction-fluid-mechanics/the-drag-of-a-body).

* cited by examiner

MICROCHANNEL, MICROFLUIDIC CHIP AND METHOD FOR PROCESSING MICROPARTICLES IN A FLUID FLOW

BACKGROUND

The invention relates to a microchannel, a microfluidic chip and a method for processing microparticles in a fluid flow.

For biological assays, chemical tests, chemical synthesis, processing of samples or biological fluids may require processing microparticles. For example, processing microparticles carrying different analytes on their surface may allow for surface-based assays for detecting different types of analytes including (but not limited to) DNA sequences, antigens, lipids, proteins, peptides, hydrocarbons, toxins, chemical compounds or cells. Analysis on microparticles carrying analytes may be performed, for example, by optical or electrochemical monitoring, applying fluorescence, magnetism-based sensing, fluorescence quenching.

Dielectrophoresis relates to the motion of polarizable particles in a non-uniform or asymmetric electric field. In particular, microparticles subjected to an electric field become polarized and make up dipoles aligned to the applied field. In a non-uniform electric field, each half of the dipole experiences unequal Coulomb forces, and a net force is exerted on the microparticle. Depending on dielectric properties including structural, morphological and chemical characteristics, the microparticles respond differently to the applied asymmetric electric field.

SUMMARY

According to a first aspect, the invention can be embodied as a microchannel for processing microparticles in a fluid flow. The microchannel comprises a first pair of electrodes and second pair of electrodes. The first pair of electrodes is configured to generate an asymmetric first electric field for sorting the microparticles to provide sorted microparticles. The second pair of electrodes is configured to generate an asymmetric second electric field for trapping at least some of the sorted microparticles.

According to a second aspect, the invention can be embodied as a microfluidic chip comprising a microchannel according to the first aspect of the invention.

According to a third aspect, the invention can be embodied as a method for arranging microparticles in a fluid flow in a microchannel. The method comprises sorting the microparticles by an asymmetric first electric field to provide sorted microparticles and trapping at least some of the sorted microparticles by an asymmetric second electric field.

In the following, exemplary embodiments of the present invention are described with reference to the enclosed figures.

BRIEF DESCRIPTION OF THE DRAWINGS

Similar or functionally similar elements in the figures have been allocated the same reference signs if not otherwise indicated.

DETAILED DESCRIPTION

In the following, moving or deflecting microparticles, in particular polarizable microparticles, by applying an electric field involves the above principles of dielectrophoresis, unless specified otherwise. In particular, an asymmetric electric field as evoked herein (in particular for sorting, trapping and concentrating particles) is such that a microparticle subject to such an electric field will deviate from an average direction of the fluid flow in the microchannel. Typically, asymmetric electric fields involve fringing fields extending through a medium (e.g., a liquid in a microchannel) from one electrode to another, the field being influenced by the shapes and proximity of the electrodes. Such asymmetric electric fields typically have the strongest gradient near the edges of the electrodes.

Figure 1:
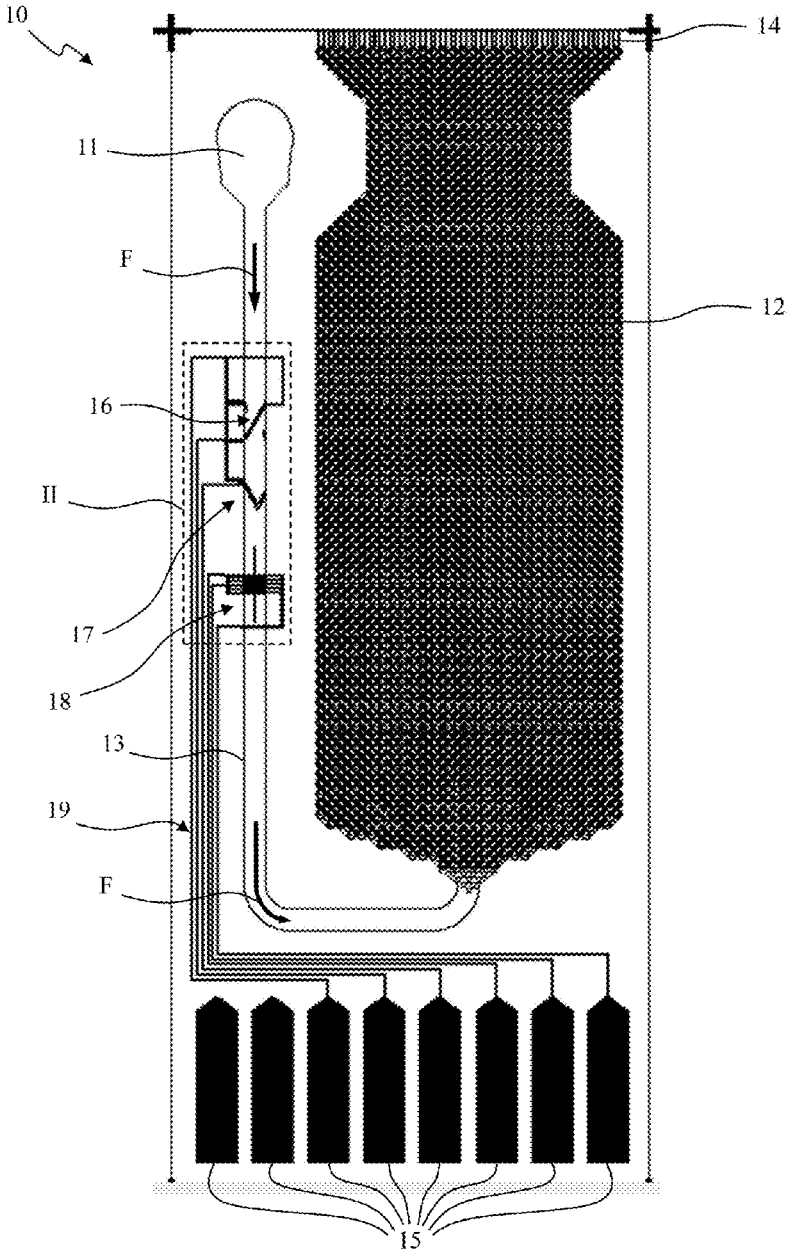
FIG. 1 shows a schematic top view of an embodiment of a microfluidic chip.

FIG. 1 shows a schematic top view of an embodiment of a microfluidic chip 10. In particular, the microfluidic chip 10 is shown in FIG. 1 with a top face deflected or being transparent. The microfluidic chip 10 can comprise an inlet port 11, a capillary pump 12 and a microchannel 13. The microchannel 13 can fluidly connect the inlet port 11 and the capillary pump 12 to each other. At least a portion of the microchannel 13 may have a linear and/or elongated shape. The microchannel 13 may be tapered or widened at specific positions for changing a hydraulic flow resistance in order to adjust a flow rate and a velocity of the fluid carrying suspended microparticles. The capillary pump 12 may be connected to an air vent 14 that opens outward. The inlet port 11 may be connected to an external fluid supply.

For example, the elements and devices of the microfluidic chip 10 may be formed by: anisotropic wet etching using silicon substrate and silicon oxide or nitride as mask; thermal oxidation for electrical passivation; patterning a conductive layer (preferably comprising gold, platinum, palladium and/or aluminum) by etching or lift-off; and sealing microfluidic structures preferably using a pre-patterned adhesive film, elastomer, thermoplastic and/or dry-film resist.

Alternatively, the elements and devices of the microfluidic chip 10 may be formed by: providing a substrate (e.g. plastics, FR-4 materials, polydimethylsiloxane (PDMS), preferably silicon) with a passivated layer (e.g. silicon dioxide); patterning electrodes and contacts (preferably comprising gold, platinum, palladium, titanium and/or aluminum) by an etching and/or lift-off process; patterning microfluidic structures by structuring a photosensitive layer (e.g. SU-8 materials, positive photoresist, dry-film resist) or etching a deposited film (e.g. parylene or polyimide); and sealing microfluidic structures using a pre-patterned adhesive film, elastomer, thermoplastic or dry-film resist.

Alternatively, the elements and devices of the microfluidic chip 10 may be formed by: providing a substrate; structuring the microfluidic structures by etching (for silicon or glass), embossing or injection molding (for plastics) and/or soft-lithography (for elastomers); patterning electrodes on a cover layer (preferably comprising glass, silicon, dry-film resist, plastics and/or PDMS); and sealing microfluidic structures by bonding two substrates, e.g. by anodic bonding, adhesive bonding or thermoplastic bonding.

For example, the microfluidic chip 10 may be plugged to an electrical socket. A fluid can then be pipetted to the inlet port 11 and pulled toward the capillary pump 12 by a capillary force, thereby flowing along the microchannel 13. Alternatively or additionally, the fluid flow F may be generated by a pump or any other device generating an according pressure gradient. In FIG. 1, the arrow F can refer to both the fluid flow and a direction of the fluid flow. The fluid contains microparticles that move along the fluid flow F with a velocity of $10^{-6}$ m/s to $10^{-1}$ m/s, preferably $10^{-4}$ m/s to $10^{2}$ m/s.

The fluid may comprise water (distilled, deionized, tap water or water in natural resources), biological buffers such as phosphate-buffered saline (PBS) and Tris-acetate-EDTA (TAE) buffer, human serum, urine and/or saliva. Furthermore, surfactants such as Tween® 20 may be added to the fluid to minimize an aggregation of the microparticles.

In particular, the microparticles are polarizable in an external electric field, i.e. an electric dipole moment is induced at the microparticles by the applied field. A typical size of the microparticles can be in a submillimeter range, preferably from $10^{-8}$ m to $10^{-3}$ m and even more preferably $10^{-6}$ m to $10^{-4}$ m. For example, the microparticles comprise beads, microbeads, microspheres. Preferably, the microparticles are suited for capturing other particles, for example biological analytes including cells. The capture of the particles may employ a chemical and/or physical bonding, for example adsorption. Accordingly, the microparticles may have receptors at the surface for capturing smaller particles. The microparticles may have a functionalized surface, e.g. the surface may be amine-terminated, COOH-terminated and/or functionalized with biotin, streptavidin, protein, nucleotides, or oligonucleotides from deoxyribonucleic acid (DNA) or ribonucleic acid (RNA). The microparticles may comprise silica, latex, agarose, one or more polymers, and/or may have a magnetic core. Preferably, the microparticles comprise polystyrene.

In particular, the fluid flow F may follow the principles of microfluidics. Accordingly, typical dimensions of the microchannel 13 can range between $10^{-7}$ m to $10^{-3}$ m. Further, typical volumes of the fluid, in particular in a microfluidic device, can range from $10^{-15}$ L to $10^{-5}$ L.

The microfluidic chip 10 further comprises a plurality of electrical contacts 15. In particular, the electrical contacts 15 may be exposed so as to enable an electrical connection to external devices, in particular to a power supply, using sockets, spring-loaded contacts (e.g. Pogo pins), solders, or wirebonds. The electrical contacts 15 can be electrically connected to a concentrating element 16, a sorting element 17, a trapping element 18 and/or further elements. One or more power lines 19 may connect these elements with the respective electrical contact 15.

The capillary pump 12 in particular involves effects of capillarity. The use of the capillary pump 12 could be beneficial in terms of compactness and low cost. Alternatively, microfluidic pumps could be used. Further the capillary pump 13 may eliminate the necessity of microfluidic connectors. A surface tension of the fluid, e.g. water, in the microchannel 13 and adhesive forces between the fluid and inner walls may generate a force that drives the fluid from the inlet port 11 toward the capillary pump 12. The capillary pump 12 may include a plurality of parallel channels in order to increase a capillarity pressure along the microchannel 13. Further, the capillary pump 12 may include a plurality of posts, bars, shapes (e.g. round-shaped or polygonal), etc. arranged in a structure for allowing for a number of parallel flow paths, thereby decreasing a flow resistance. The flow rate can be tuned by changing the wetting properties of the surfaces, hydraulic flow resistance of the microchannels and the viscosity of the liquid. The air vent 14 may be configured for discharging a fluid (e.g. air in the pump) from the capillary pump 12 for eliminating compression of the air in the capillary pump 12.

Generally, capillary pumps can generate lower flow rates and allow for a more precise control of the flow rate compared to external pumps, in particular microfluidic pumps. A non-uniform advancing of the liquid front during the capillary flow can form air bubbles, which may lead to erroneous results in processing of the microparticles and the analysis. Therefore, it could be advantageous to prevent the formation of bubbles in the microchannel 13 as well as undesired sticking of microparticles at the inner walls of the microchannel 13.

Figure 2:
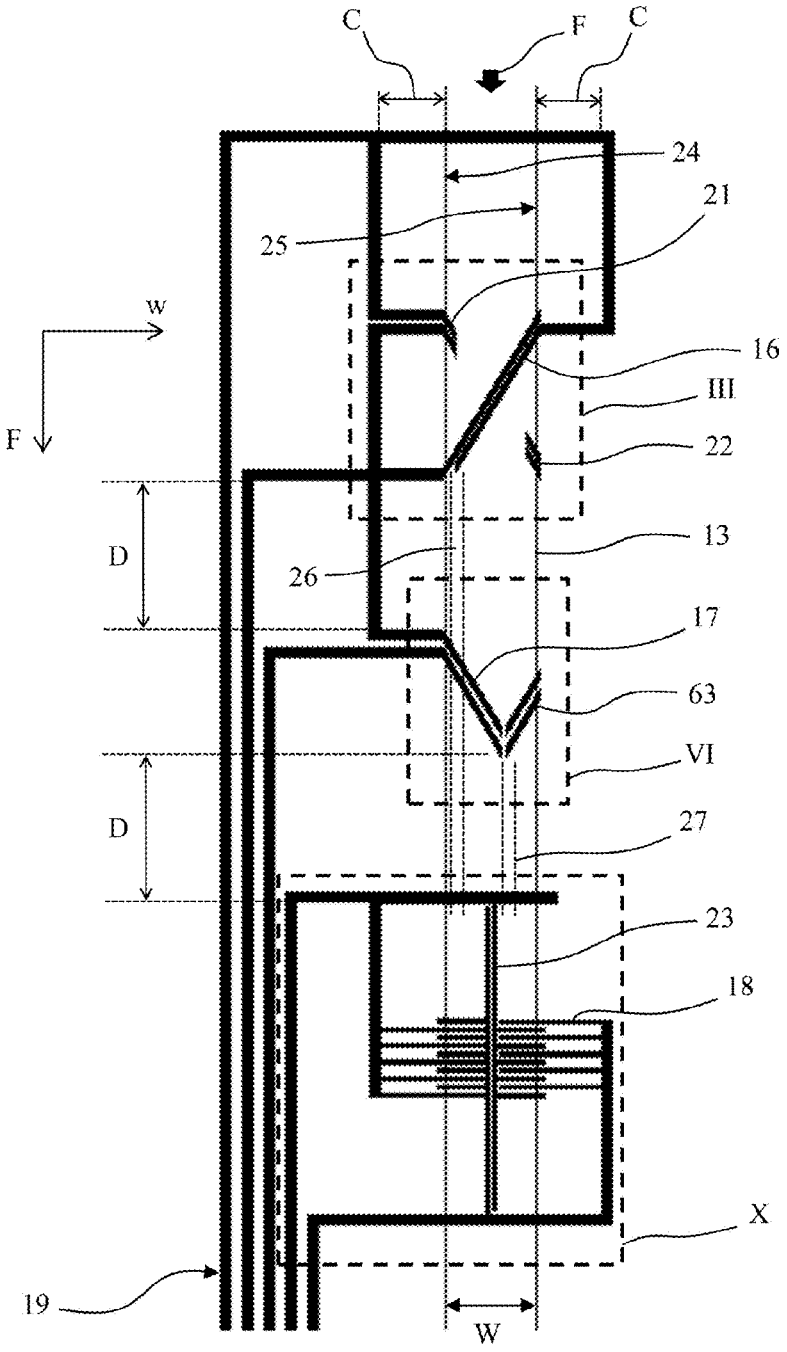
FIG. 2 shows a partial view II of FIG. 1.

FIG. 2 shows a partial view II of FIG. 1. In FIG. 2, the fluid containing microparticles flows downward as indicated by the arrow F.

The microfluidic chip 10 can comprise a plurality of different elements and devices for sorting and trapping microparticles. For example, a spacing element 21, a decelerating element 22, a partitioning element 23, the concentrating element 16, the sorting element 17 and the trapping element 18 are attached to a first inner wall 24 and/or a second inner wall 25 of the microfluidic channel 13. In particular, the first and second inner walls 24, 25 are parallel to each other. The power lines 19 connect the elements 16-18, 21-23 to one of the electrical contacts 15.

A width W of the microchannel 13 can be $10^{-6}$ m to $10^{-2}$ m, preferably $10^{-5}$ m to $10^{-3}$ m. Distances D between element sets can be $10^{-5}$ m to $10^{-2}$ m, preferably $10^{-4}$ m to $10^{-3}$ m. A minimum distance C of the power lines 19 from the inner walls 24, 25 of the microchannel 13 can be $10^{-5}$ m to $10^{-2}$ m, preferably $5.10^{-5}$ m to $10^{-3}$ m. Distance D may prevent an electrical cross-talk between the different elements for concentrating, sorting and trapping. Similarly, distance C may prevent an electrical cross-talk between the power lines 19 and electrodes inside the microchannel 13. In particular, such electrical cross-talks may influence the sorting and trapping elements 17, 18 by coupling through the substrate, sealing layer, air and the liquid.

Microparticles which come into contact with the inner walls 24, 25 can lead to an aggregation of microparticles because the velocity of the liquid decreases towards the inner walls 24, 25 under the laminar flow regime. Such aggregation of microparticles can impair the fluid flow F and operation of the microfluidic chip 10. In FIG. 2, the spacing element 21 comprises a pair of electrodes for generating an electric field that repels the microparticles so as to push them away from the first inner wall 24.

The concentrating element 16 can comprise a pair of linearly shaped electrodes. Generally, the microparticles moving in the fluid along the microchannel 13 are randomly distributed over the width W. The electrodes of the concentrating element 16 preferably generate an asymmetric electric field that concentrates the microparticles with respect to the width W of the microchannel 13, i.e. drives them into a column 26 with a smaller width than the width W of the microchannel 13. In other words, a spatial distribution of the microparticles is locally limited to the column 26 in terms of a w-direction, i.e. a direction parallel to the width W of the microchannel 13. For example, the microparticles passing through the electric field of the concentrating element 16 may experience a force perpendicular to the fluid flow direction F and/or in a direction parallel to the linear extension of the electrodes. Preferably, the microparticles are deflected toward one of the inner walls 24, 25 (without touching the inner walls 24, 25) in order to provide a space as wide (i.e. in the w-direction) as possible for a sorting process of the microparticles. In FIG. 2, the microparticles are deflected toward the first inner wall 24 by the electric field of the concentrating element 16.

The electrodes of the concentrating element 16 may be arranged parallel to each other. In particular, one of the electrodes can extend between the first and second inner walls 24, 25 whereas the other electrode extend from the second inner wall 25 into the microchannel 13 without reaching the first inner wall 24 in order not to move the microparticles so far as to touch the first inner wall 24. The gap between the electrode and the first inner wall 24 can be $10^{-6}$ m to $10^{-3}$ m, preferably $10^{-5}$ m to $10^{-4}$ m. After being concentrated by the concentrating element 16, the microparticles move inside the column 26 along the fluid flow F, preferably a laminar flow.

The sorting element 17 can comprise a pair of linearly shaped electrodes for generating an asymmetric electric field that selectively moves the microparticles depending on their properties and thereby provide sorted microparticles. In particular, the properties of the microparticles can comprise size, permittivity, polarizability, porosity and/or material. As a result, the microparticles passing through the electric field of the sorting element 17 can be shifted into different positions in terms of w-direction. For example, microparticles having a diameter of 10 μm can be displaced further in the w-direction than microparticles having a diameter of 5 μm since the dielectrophoretic force increases with increasing microparticle size. Further, the sorting element 17 can be configured to divide the microparticles into a plurality of particles groups by selectively moving them depending on their properties.

The partitioning element 23 is configured to prohibit the sorted microparticles and/or the particle groups from intermixing, i.e. to prevent the microparticles of one particle group joining the microparticles from another particle group, particularly while they are trapped on the trapping element 18. Preferably, the partitioning element 23 is linearly shaped along the microchannel 13 and arranged parallel to each other between the inner walls 24, 25. For example, the partitioning element 23 comprises a pair of electrodes for generating a repulsive electric field and/or a solid barrier.

The trapping element 18 is configured to trap the sorted microparticles in specified areas. Trapping can refer to retaining, arresting, positioning, localizing microparticles at one or more defined positions. Trapping microparticles may facilitate imaging and/or processing microparticles, e.g. for an analysis, or increasing their concentration. For example, the trapping element 18 can comprise a plurality of linearly shaped electrodes in an interdigitated arrangement as shown in FIG. 2.

Figure 3:
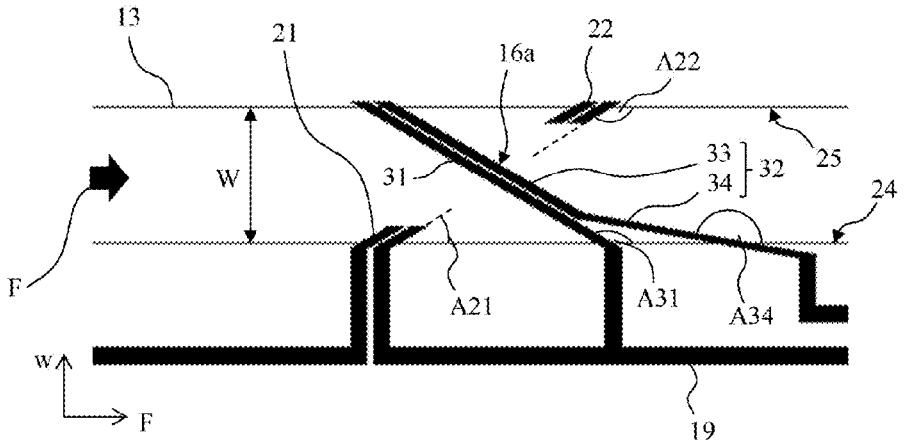
FIG. 3 shows a partial view III of FIG. 2.

FIG. 3 shows a partial view III of FIG. 2. In particular, FIG. 3 shows a further embodiment of the concentrating element 16*a*.

The spacing element 21 and the concentrating element 16*a* are connected to the power lines 19. The spacing element 21 is attached to the first inner wall 24 and extends from the first inner wall 24 into the microchannel 13. Preferably, the spacing element 21 comprises a pair of linearly shaped electrodes arranged parallel to each other. The spacing element 21 intersects the first inner wall 24 at an angle of intersection A21. The angle of intersection A21 is preferably an acute angle, i.e. at most 89°. The spacing element 21 can generate a repulsive electric field for repelling the microparticles in order to push the microparticles away from the first inner wall 24. A length of the electrodes of the spacing element 21 can be $10^{-6}$ m to $10^{-3}$ m, preferably $10^{-5}$ m to $10^{-4}$ m.

The concentrating element 16*a* can comprise a pair of electrodes extending between the first and second inner walls 24, 25. In FIG. 3, the concentrating element 16*a* comprises a first electrode 31 and a second electrode 32, with the first electrode 31 arranged upstream of the second electrode with respect to the fluid flow F. Preferably, the first electrode 31 is shorter than the second electrode 32 in order not to push the microparticles all the way to the microfluidic inner wall 24. The first electrode 31 can be inclined at an angle A31 to the first inner wall 24. Preferably, the angle A31 is an obtuse angle of at least 91°, more preferably 120°-150°.

The second electrode 32 can comprise two sections 33, 34 that are linearly shaped and connected to each other inside the microchannel 13. A first section 33 can extend from the second inner wall 25 into the microchannel 13 and is arranged parallel to the first electrode 31. A second section 34 can extend from the first inner wall 24 into the microchannel 13. The second section 34 can be inclined at an angle A34 to the first inner wall 24. Preferably, the angle A34 is greater than the angle A31. As a result, a gap between the first and second electrodes 31, 32 can widen from the second inner wall 25 toward the first inner wall 24 in order not to move the microparticles so far as to touch the first inner wall 24.

The pair of electrodes 31, 32 of the concentrating element 16*a* is configured to generate an electric field for concentrating the microparticles in the fluid flow F in the manner described above. Preferably, the microparticles passing through the electric field of the concentrating element 16*a* move toward the first inner wall 24 without coming into contact with the inner wall 24.

Figure 4:
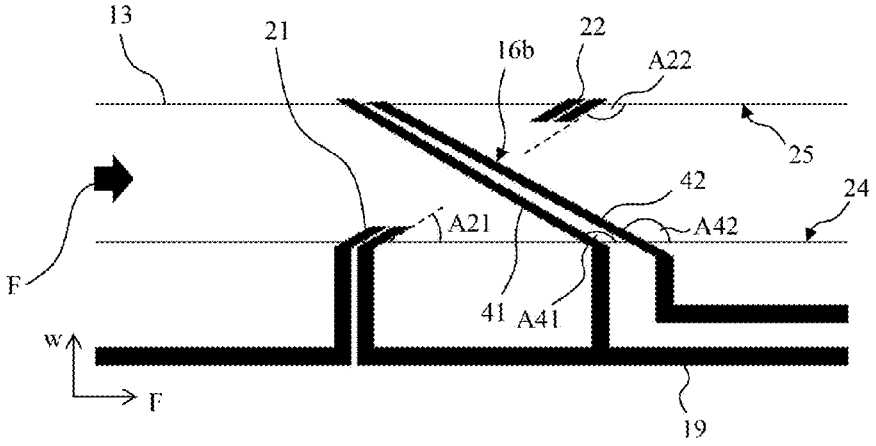
FIG. 4 shows a further partial view III of FIG. 2 illustrating a further embodiment of a concentrating pair of electrodes.

FIG. 4 shows a partial view III of FIG. 2 illustrating a further embodiment of a concentrating element 16*b*.

The concentrating element 16*b* can comprise a first electrode 41 and a second electrode 42, with the first electrode 41 arranged upstream of the second electrode 42 with respect to the fluid flow direction F. Preferably, the first electrode 41 is shorter than the second electrode 42. The first and second electrodes 41, 42 can extend between the inner walls 24, 25. The first and second electrodes 41, 42 can be linearly shaped. The first electrode 41 can be inclined at an angle A41 to the first inner wall 24. The second electrode 42 can be inclined at an angle A42 to the first inner wall 24. The angles A41, A42 are preferably an obtuse angle and more preferably 120°-150°. Preferably, the angle A41 is greater than the angle A42 so that a gap between the first and second electrodes 41, 42 widens from the second inner wall 25 to the first inner wall 24. In particular, a position in the w-direction to which the microparticles are concentrated by the electric field of the concentrating element 16*b* may be tuned, for example by adjusting an amplitude and/or frequency of the applied signal and/or changing electrical properties of the microparticles and/or the fluid, so that the location of column 26 can be adjusted For all embodiments of the concentrating elements 16, 16*a*, 16*b*, the linearly shaped electrodes may have a width of $10^{-6}$ m to $10^{-4}$ m, preferably $10^{-5}$ m to $5.10^{-5}$ m. The gap between two electrodes of the pair of electrodes may be $10^{-6}$ m to $10^{-4}$ m, preferably $5.10^{-6}$ m to $5.10^{-5}$ m.

In FIG. 2-4, the decelerating element 22 is attached to the second inner wall 25. For example, the decelerating element 22 comprises a pair of linearly shaped metallic contacts that are arranged parallel to each other. In particular, the decelerating element 22 is not connected to the power lines 19 or any of the electrical contacts 15. In particular, the decelerating element 22 is declined at an angle A22 to the second inner wall 25. Preferably, the angle A22 is an obtuse angle, and more preferably 120°-150°. The geometry of the decelerating element 22 may be chosen in accordance with the spacing element 21 for the sake of symmetry.

Some metals, such as Au and Pd, can be less hydrophilic than the surface of the microchannel 13, which is typically glass or $SiO_2$. Such inhomogeneity in the hydrophilicity can lead to a non-uniform fluid flow during the capillary flow of the liquid. A non-uniform fluid flow can result in an instability such as bubble that can impair the operation of the microfluidic chip 10. The decelerating element 22 can contribute to a uniformity of the fluid flow through the microchannel 13 by slowing down a part of the initial fluid flow that moves along the second inner wall 25. In particular, the decelerating element 22 slows down the corresponding portion of the fluid flow during an initial filling process of the microchannel 13.

Figure 5:
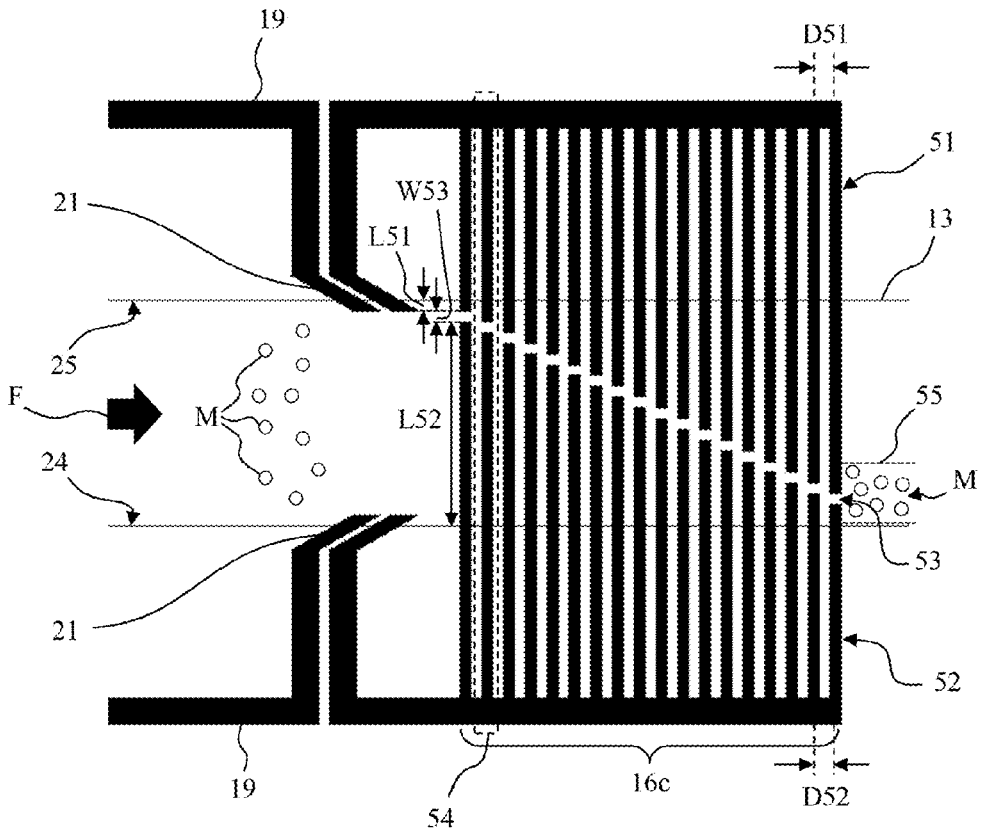
FIG. 5 shows an embodiment of a concentrating element.

FIG. 5 shows a further embodiment of a concentrating element 16*c*. In FIG. 5, a spacing element 21 is attached to each of the first and second inner walls 24, 25. The spacing elements 21 generate a repulsive electric field for repelling microparticles M from the respective inner wall 24, 25. The concentrating element 16*c* comprises a plurality of linearly shaped electrodes arranged parallel to one another. One half of the linearly shaped electrodes 51 extend from the first inner wall 24 into the microchannel 13, and the other half of the linearly shaped electrodes 52 extend from the second inner wall 25 into the microchannel. Preferably, a distance D51 between two neighboring electrodes 51 is constant, and a distance D52 between two neighboring electrodes 52 is constant. Preferably, the electrodes 51, 52 are arranged such that the distances D51, D52 are equal. Each electrode of the one half is arranged in line with one electrode of the other half such that a gap 53 is formed in between. Two electrodes arranged in line form a pair of electrodes 54.

For example, a length L51 of the electrodes 51 grows in the fluid flow direction F, and a length L52 of the electrodes 52 decreases in the fluid flow direction F. Here, the lengths L51, L52 can refer to a spatial extension of the respective electrodes 51, 52 in the w-direction. A width W53 of the gap 53 may be constant. As a result, a position of the gap 53 moves from near the second inner wall 25 toward the first inner wall 24 in the fluid flow direction F. For example, the lengths L51, L52 change in a manner that the position of the gap 53 changes linearly from the second inner wall 25 toward the first inner wall 24 along the direction of the fluid flow F.

In particular, the electrodes are configured to generate an electric field that moves the microparticles M toward the position of the respective gap 53. After passing through the electric field of the concentrating element 16*c*, the microparticles M are positioned inside a column 55.

Figure 6:
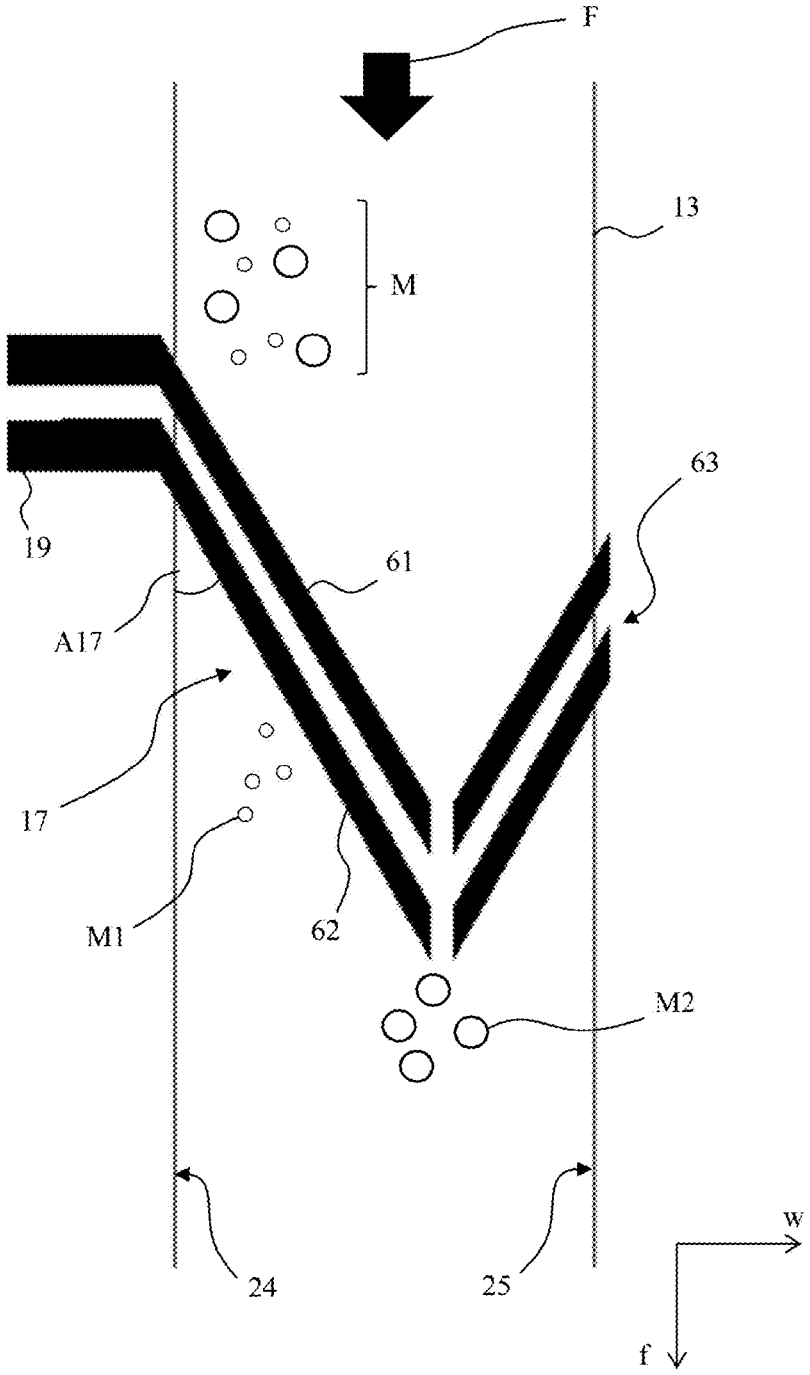
FIG. 6 shows a partial view VI of FIG. 2.

FIG. 6 shows a partial view VI of FIG. 2. In particular, FIG. 6 shows the sorting element 17 in an enlarged view. The sorting element 17 can comprise a pair of linearly shaped electrodes 61, 62 that extend from the first inner wall 24 into the microchannel 13. For example, the electrodes 61, 62 are inclined at an angle A11 to the first inner wall 24. Preferably, the angle A11 is an acute angle and more preferably 30°-60°. Outside of the microchannel 13, the power line 19 connects the sorting element 17 to the electrical contacts 15. Furthermore, the electrodes 61, 62 may be inclined differently to the first inner wall 24 such that a gap between the electrodes 61, 62 widens or tapers from the first inner wall 24 toward the second inner wall 25. The electrodes 61, 62 may have a width of $10^{-7}$ m to $10^{-3}$ m, preferably $10^{-6}$ m to $10^{-4}$ m. The gap between the electrodes may have a width of $10^{-7}$ m to $10^{-3}$ m, preferably $10^{-6}$ m to $10^{-4}$ m. An extension of the sorting element 17 in the w-direction may be 30% to 90%, preferably 40% to 80%, of the width W of the microchannel 13.

A further decelerating element 63 extends from the second inner wall 25 into the microchannel 13. The decelerating element 63 can comprise a pair of linearly shaped metallic bodies arranged parallel to each other, as shown in FIG. 6. For example, the decelerating element 63 is not connected to any of the power lines 19 or the electrical contacts 15. The decelerating element 63, similar to the decelerating element 22 described above, can contribute to a uniformity of the fluid flow through the microchannel 13 by slowing down a part of the initial fluid flow that moves along the second inner wall 25. For example, the decelerating element 63 slows down the corresponding portion of the fluid flow during an initial filling process of the microchannel 13. In particular, the decelerating element 63 compensates a decelerating effect of the sorting element 17 during an initial filling process of the microchannel 13.

The electrodes 61, 62 of the sorting element 17 are configured to generate an electric field, in particular an asymmetric electric field, for sorting the microparticles M in the fluid flow F, thereby providing sorted microparticles. For example, the microparticles M can comprise a first group of microparticles M1 and a second group of microparticles M2, with the microparticles of the first group of microparticles M1 being smaller than those of the second group of microparticles M2. In the electric field generated by the sorting element 17, microparticles M2 may be forced to move toward the second inner wall 25, whereas the microparticles M1 are less affected or not affected. As a result, the microparticles M2 are positioned in a central part of the microchannel 13 with respect to the w-direction, and the microparticles M1 stay in a position close to the first inner wall 24.

Further, the microparticles M in the fluid flow F can comprise more than two randomly mixed groups of microparticles. The sorting element 17 may then be suited for dividing the microparticles M into N respective groups of M1-MN depending on their properties. Amplitude and/or frequency of the applied signal and/or the extension of the sorting element 17 in the w-direction, and/or the tapered gap between the electrodes 61, 62 can be tuned to adjust the position of the microparticles M1 in microchannel 13 with respect to the w-direction.

Figure 7:
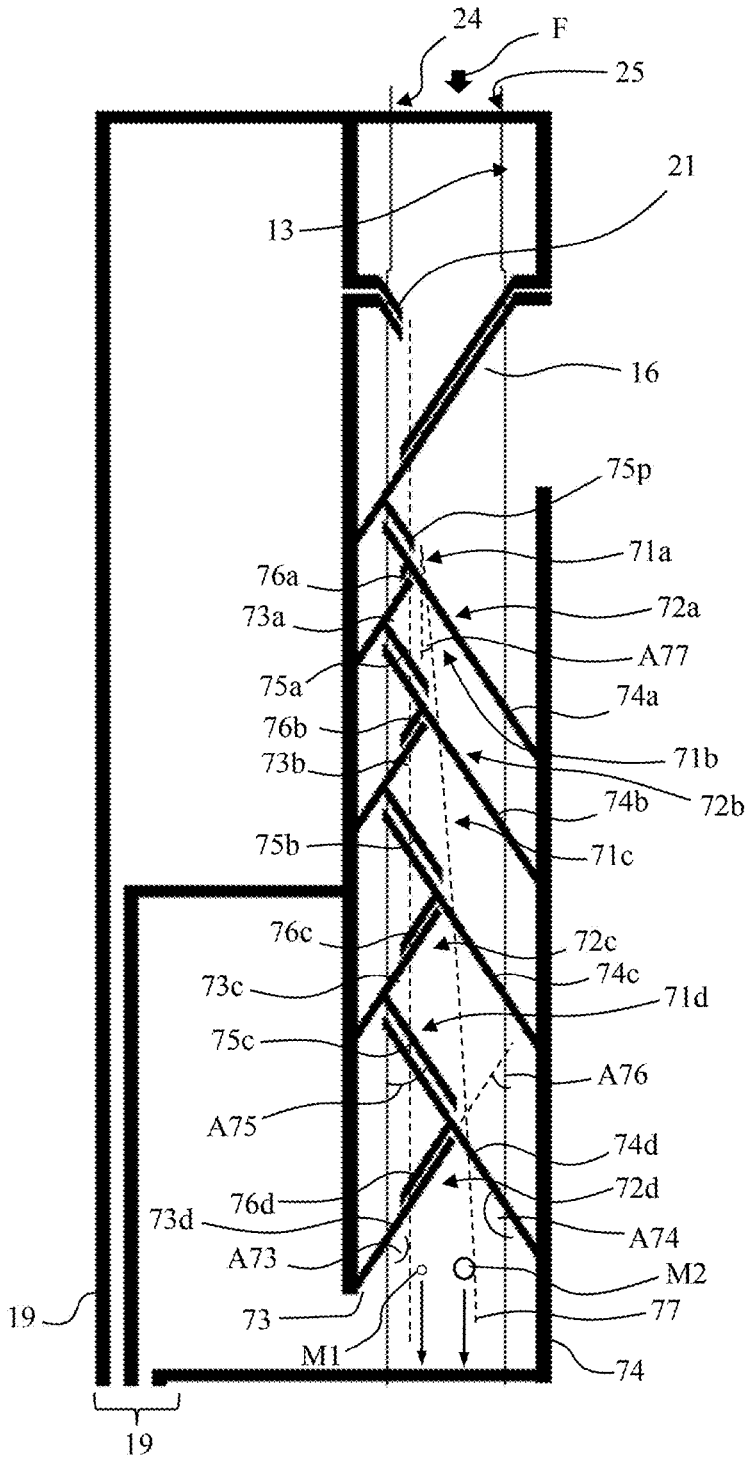
FIG. 7 shows a schematic view of a further embodiment of a concentrating element and a sorting element.

FIG. 7 shows a schematic view of a further embodiment of the microchannel 13 including a plurality of sorting elements 71*a*-71*d* and a plurality of concentrating elements 72*a*-72*d*.

Two intermediate power lines 73, 74 that are connected to the power lines 19 may be arranged outside of the microchannel 13, with a first intermediate power line 73 being close to the first inner wall 24 and a second intermediate power line 74 being close to the second inner wall 25. For example, the intermediate power lines 73, 74 are arranged parallel to the first and second inner walls 24, 25.

A plurality of first electrodes 73*a*-73*d* may be formed extending from the first intermediate power line 73 into the microchannel 13. The first electrodes 73*a*-73*d* may be arranged parallel to one another and inclined at an angle A73 to the first inner wall 24. Preferably, the angle A73 is an obtuse angle, more preferably 120°-150°. In particular, the first electrodes 73*a*-73*d* can be arranged parallel to the concentrating element 16. The first electrodes 73*a*-73*d* can extend toward the second inner wall 25 such that that the first electrodes 73*a*-73*d* end in a boundary line 77 inside the microchannel 13. The boundary line 77 can be inclined at an angle A77 to the first inner wall 24. The angle A77 can be an acute angle, preferably 5°-30°.

A plurality of second electrodes 74*a*-74*d* may be formed extending between the first and second intermediate power lines 73, 74 across the microchannel 13. The first electrodes 74*a*-74*d* may be arranged parallel to one another and inclined at an angle A74 to the second inner wall 25. The angle A74 is preferably an obtuse angle, more preferably 120°-150°.

A plurality of first branches 75*a*-75*c* may be formed being connected to the first electrodes 73*a*-73*c*, respectively. In particular, the first branches 75*a*-75*c* can be connected to the respective first electrodes 73*a*-73*c* at a position where the first electrodes 73*a*-73*c* intersect the first inner wall 24. A further first branch 75*p* may be formed being connected to one of the electrodes of the concentrating element 16. The first branches 75*a*-75*p* may be linearly shaped and arranged parallel to one another. In particular, the first branches 75*a*-75*p* can be inclined at an angle A75 to the first inner wall 24. Preferably, the first branches 75*a*-75*p* are arranged parallel to the second electrodes 74*a*-74*d*. Preferably, the first branches 75*a*-75*d* extend toward the second inner wall 25 as far as to the boundary line 77. The first branches 75*a*-75*p* may be electrically conductive, in particular metallic electrodes.

A plurality of second branches 76*a*-76*d* may be formed being connected to the second electrodes 74*a*-74*d*, respectively. In particular, the second branches 76*a*-76*d* can be connected to the respective second electrodes 74*a*-74*d* at a position where the second electrodes 74*a*-74*d* intersects the boundary line 77. The second branches 76*a*-76*d* may be electrically conductive, in particular metallic electrodes. The second branches 76*a*-76*d* may be linearly shaped and arranged parallel to one another. In particular, the second branches 76*a*-76*d* can be inclined at an angle A76 to the second inner wall 25. Preferably, the second branches 76*a*-76*d* are arranged parallel to the first electrodes 73*a*-73*d*.

The first branch 75*p* with the second electrode 74*a* builds the sorting element 71*a*. The first branches 75*a*-75*c* build with the second electrodes 74*b*-74*d*, respectively, the sorting elements 71*b*-71*d*. Each of the sorting elements 71*a*-71*d* is configured to generate an electric field for selectively moving the microparticles depending on their properties.

The second branches 76*a*-76*d* build with the first electrodes 73*a*-73*d*, respectively, the concentrating elements 72*a*-72*d*. Each of the concentrating elements 72*a*-72*d* is configured to generate an electric field for concentrating the microparticles in the w-direction.

In total, a cascade of concentrating elements 72*a*-72*d* and sorting elements 71*a*-71*d* is provided. For example, a part of the microparticles M that passes the electric field of the sorting elements 71*a*-71*c* without being affected can be concentrated by the concentrating elements 72*a* -72*c* for being sorted by the following sorting elements 71*b*-71*d*. Preferably, sorting of the microparticles can be performed gradually since the microparticles with different properties react differently to the electric fields of the sorting elements 71*a*-71*d*. In this manner, a sorting efficacy can be increased and the risk of having unsorted bigger particles ending up in the region of smaller particles can be minimized In particular, smaller microparticles, e.g. spherical particles with a diameter of 3-5 μm, can be deflected toward the first inner wall 24 by the concentrating elements 72*a*-72*d*. Bigger microparticles, e.g. spherical particles with a diameter of 8-10 μm, can be deflected toward the second inner wall 25 by the sorting elements 71*a*-71*d*. Unsorted bigger microparticles, i.e. a part of the bigger microparticles that is not affected by the preceding sorting element 71*a*-71*c*, can be deflected toward the first inner wall 24 by the concentrating element 72*a*-72*c* and sorted by the following sorting element 71*b*-71*d*. As a result, the bigger microparticles move in a column near the second inner wall 25, while the smaller microparticles move in a column near the first inner wall 24. The number of sorting and concentrating elements can be adjusted according to the dimensions of the particles, area reserved for these elements and the required efficacy.

In this embodiment, the sorting elements 71*a*-71*d* and the concentrating elements 72*a*-72*d* are electrically coupled to one another by being connected to both intermediate lines 73, 74. In order to increase the Dielectrophoresis forces for the concentrating elements 72*a*-72*d*, a concentrator gap between the second branches 76*a*-76*d* and the respective first electrodes 73*a*-73*d* is smaller than a sorter gap between the first branches 75*p*, 75*a*-75*c* and the respective second electrodes 74*a*-74*d*. A ratio of the concentrator gap to the sorter gap can be, for example, 0.1 to 0.9, preferably 0.3 to 0.7, with the concentrator and sorter gaps being $10^{-6}$ m-$10^{-4}$ m.

Figure 8:
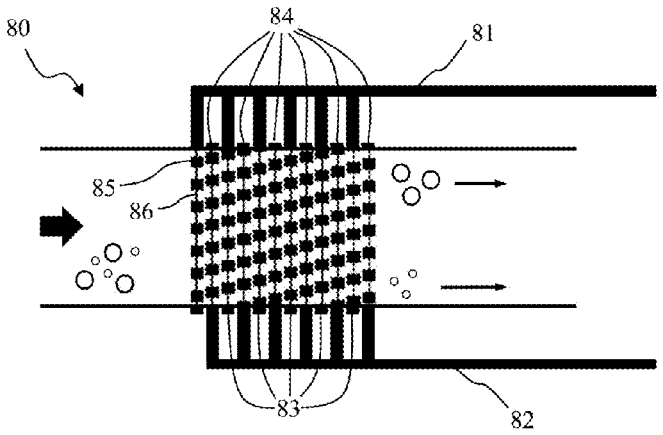
FIG. 8 shows a schematic view of a further embodiment of a sorting element.

FIG. 8 shows a schematic view of a further embodiment of a sorting element 80.

The sorting element 80 comprises two intermediate power lines 81, 82. A plurality of electrodes 83 is connected to the first intermediate power line 81 and extend toward the second intermediate power line 82 across the microchannel 13. A further plurality of electrodes 84 is connected to the second intermediate power line 82 and extend toward the first intermediate power line 81 across the microchannel 13. The electrodes 83, 84 are arranged parallel to one another in an interdigitated arrangement. Each electrode 83, 84 includes a plurality of plates 85 connected to another by a wire 86. The plates 85 are, for example, rectangular-shaped. The electrodes 83, 84 are arranged parallel to one another with a constant distance between each neighboring electrodes 83, 84.

For example, the microparticles M approach the sorting element 80 in a column near the first inner wall 24 after being concentrated by an upstream concentrating element. A first part M1 of the microparticles M that are sensitive to the asymmetric electric field of the electrodes 83, 84 can be gradually deflected toward the second inner wall 25 by the cascade of the electrodes 83, 84. A second part M2 of the microparticles M that are less or not affected by the electric fields of the electrodes 83, 84 can thereby be separated from the first part M1.

A dimension of the sorting element 80 and parameters of the applied electric field including frequency and amplitude can be tuned to define a position of the column the microparticles of the first part M1 move along as well as to keep the microparticles of the second part M2 unaffected. This embodiment can reduce the probability of microparticles not being deflected by a sorting element.

Figure 9:
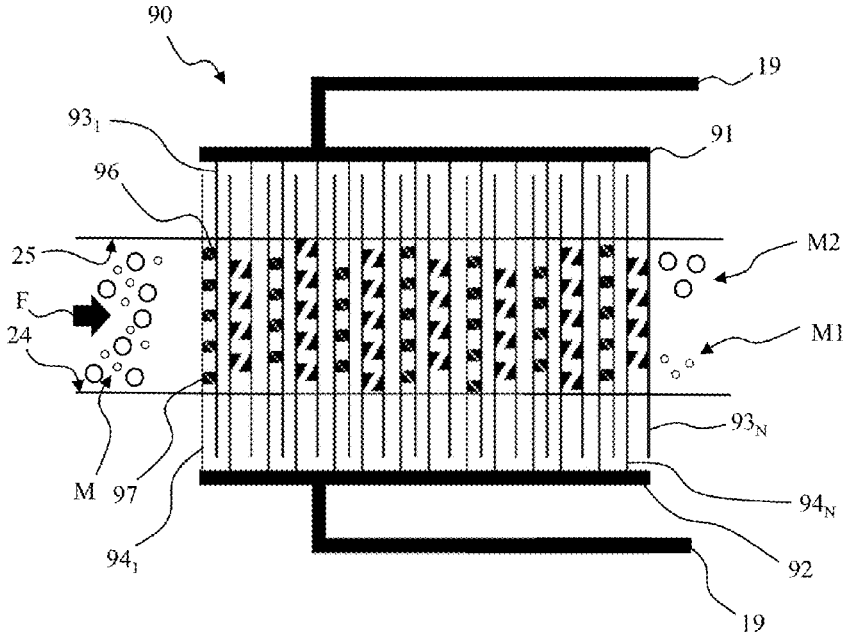
FIG. 9 shows a schematic view of a further embodiment of a sorting element.

FIG. 9 shows a schematic view of a further embodiment of a sorting element 90.

The sorting element 90 comprises two intermediate power lines 91, 92 that are connected to the power lines 19. N first electrodes $\mathbf{93}_1$-$\mathbf{93}_N$ are connected to the first intermediate power line 91 and extend toward the second intermediate power line 92 across the microchannel 13. N second electrodes $\mathbf{94}_1$-$\mathbf{94}_N$ are connected to the second intermediate power line 92 and extend toward the first intermediate power line 91 across the microchannel 13. The electrodes 93, 94 are arranged parallel to one another in an interdigitated arrangement. The first electrodes $\mathbf{93}_1$-$\mathbf{93}_N$ build with the second electrodes $\mathbf{94}_1$-$\mathbf{94}_N$, respectively, N pairs of neighboring electrodes $\mathbf{95}_1$-$\mathbf{95}_N$.

A plurality of plates 96 are attached to each of the electrodes $\mathbf{93}_1$-$\mathbf{93}_N$. A further plurality of plates 97 are attached to each of the second electrodes $\mathbf{94}_1$-$\mathbf{94}_N$. In particular, the plates 96, 97 are shaped thus that the plates 96 and the plates 97 complement one another, i.e. the plates 96 and the plate 97 geometrically add to form another, for example rectangular or circular, shape. In FIG. 9, the plates 96, 97 are triangular-shaped, and two plates 96, 97 complete a rectangular.

The plates 96, 97 can be formed between two neighboring electrodes $\mathbf{93}_1$-$\mathbf{93}_N$ and $\mathbf{94}_1$-$\mathbf{94}_N$, respectively. In FIG. 9, an orientation of an acute corner of the triangle to the rectangular corner of the triangle and a number of the triangular-shaped plates 96, 97 alternately changes. Further, a distance between the neighboring electrodes $\mathbf{93}_1$-$\mathbf{93}_N$ and $\mathbf{94}_1$-$\mathbf{94}_N$ alternately changes.

In particular, the sorting element 90 does not require a concentrating element. The microparticles M entering the electric field of the electrodes $\mathbf{93}_1$-$\mathbf{93}_N$ and $\mathbf{94}_1$-$\mathbf{94}_N$ are gradually deflected toward one of the inner walls 24, 25. A direction of the deflection depends on properties, for example size, of the microparticles M. A dimension of the sorting element 90 and parameters of the applied electric field including frequency and amplitude can be tuned to achieve, for example, that microparticles having a diameter of 8-10 μm may be deflected toward the second inner wall 25, and microparticles having a diameter of 3-5 μm may be deflected toward the first inner wall 24. The sorting element 90 provides a continuous sorting and reduces a probability of the microparticles M not to be sorted.

Figure 10:
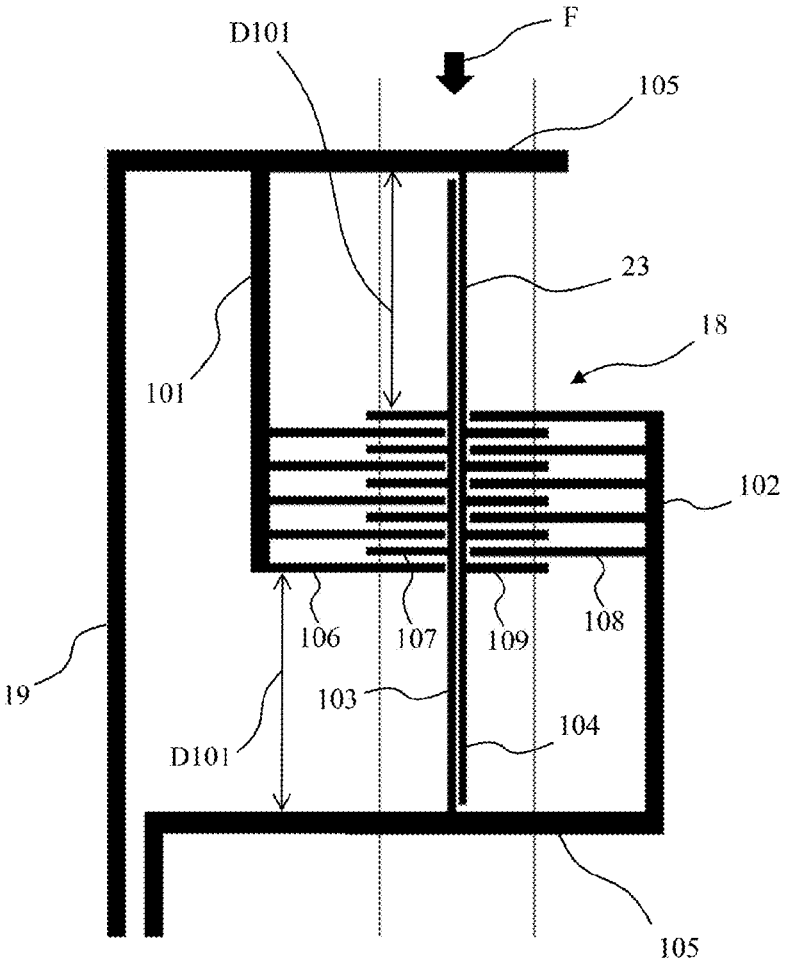
FIG. 10 shows a partial view X of FIG. 2.

FIG. 10 shows a partial view X of FIG. 2.

The partitioning element 23 can comprise a pair of linearly shaped electrodes 103, 104 arranged at the center of the microchannel 13 between the first and the second inner walls 24, 25. Preferably, the partitioning element 23 extends in a direction parallel to the fluid flow direction F.

The partitioning element 23 is configured to generate an electric field for repelling the microparticles M. Sorted microparticles are preferably not able to penetrate or move across the partitioning element 23. The partitioning element 23 is thus configured to prevent the sorted particles from intermixing.

The trapping element 18 comprises a plurality of electrodes 106-109 in an interdigitated arrangement. A first intermediate power line 101 and a second intermediate power line 102 are arranged outside of the microchannel 13 and parallel to the first and second inner walls 24, 25. The electrodes 106 are connected to the first intermediate power line 101 and extend from the first intermediate power line 101 into the microchannel 13 toward the partitioning element 23. The electrodes 108 are connected to the second intermediate power line 102 and extend from the second intermediate power line 102 into the microchannel 13 toward the partitioning element 23. Electrodes 107 extend from a third intermediate power line 103 at the center of the microchannel 13 outward and through the first inner wall 24. Electrodes 109 extend from a third intermediate power line 104 at the center of the microchannel 13 outward and through the second inner wall 25. Each of the electrodes 106-109 can have a width of $10^{-7}$ m to $10^{-3}$ m, preferably $10^{-6}$ m to $10^{-4}$ m. The electrodes 106-109 are spaced from one another constantly at a distance of $10^{-7}$ m to $10^{-3}$ m, preferably $10^{-6}$ m to $10^{-4}$ m. Different respective spacings between 106, 107 and 108, 109 may allow for generating different dielectrophoretic forces on sorted microparticles M.

Connection wires 105 extending across the microchannel 13 in the w-direction may be formed to connect the intermediate power lines 101, 102 to the power lines 19. Preferably, a distance D101 between the connection wires 105 and the nearest electrodes 106-109 is larger than the spacing between the electrodes 106-109 in order to prevent undesired bead accumulation on the connection wires 105. For example, the distance D101 can be $10^{-4}$ m-$10^{-3}$ m.

The electrodes 106-109 are configured to generate an electric field, in which sorted microparticles can be trapped. Trapped microparticles can be imaged for an analysis.

Figure 11:
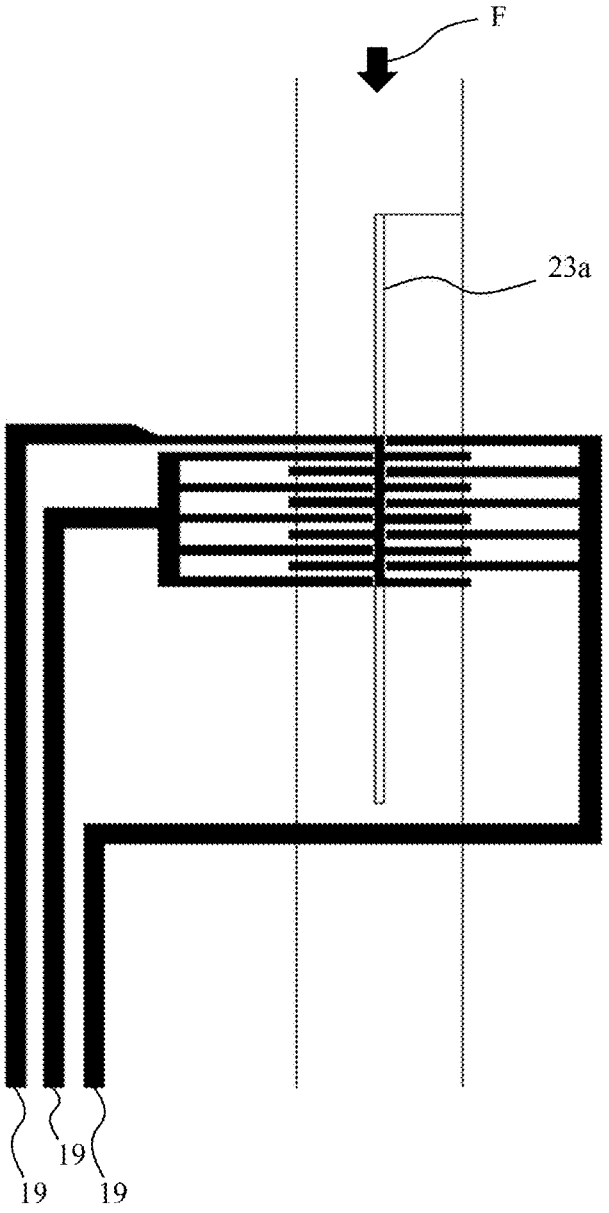
FIG. 11 shows a schematic view of a further embodiment of a partitioning element.

FIG. 11 shows a further embodiment of the partitioning element 23*a*. The partitioning element 23*a* can be formed as a physical barrier, for example a solid wall that the microparticles cannot penetrate or move across. The partitioning element 23*a* can thus prevent sorted microparticles from intermixing, which can lead to false results in the analysis. A width of the partitioning element can be $10^{-7}$ m to $10^{-3}$ m, preferably $10^{-6}$ m to $10^{-4}$ m. Preferably, the partitioning element 23*a* may be positioned at the center of the microchannel 13 so that the fluid may fill the partitioned parts uniformly without creating air bubbles.

Figure 12:
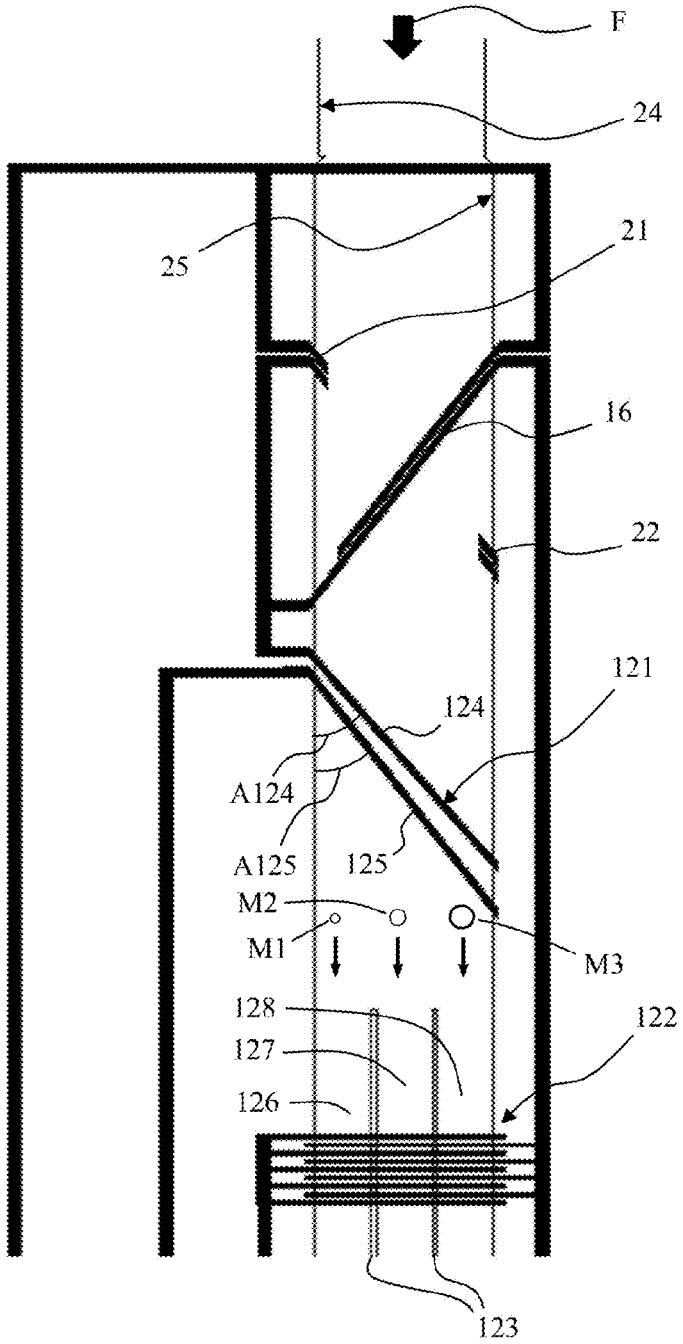
FIG. 12 shows a schematic view of a further embodiment of a sorting element and a trapping element.

FIG. 12 shows a schematic view showing a further embodiment of a sorting element 121 and a trapping element 122.

The sorting element 121 can comprise a pair of linearly shaped electrodes 124, 125 that extend across the microfluidic channel 13 crossing the inner walls 24, 25. A first electrode 124 is inclined at an angle A124 to the first inner wall 24. A second electrode 125 is inclined at an angle A125 to the first inner wall 24. The first electrode 124 is arranged upstream of the second electrode 125 with respect to the fluid flow direction F and is, in particular, shorter than the second electrode 125. For example, the first angle A124 is greater than the second angle A125 so that a gap between the electrodes 124, 125 widens from the first inner wall 24 toward the second inner wall 25.

The sorting element 121 may be configured to divide microparticles, in particular microparticles that are concentrated by a preceding concentrating element, in a plurality of groups. In particular, the sorting element 121 is configured to generate an asymmetric electric field. The microparticles M passing through this asymmetric electric field can be deflected in the w-direction. In particular, microparticles having different material, surface chemistry, topological and/or electrical properties may be differently deflected in the asymmetric electric field of the sorting element 121.

For example, the microparticles M may include three groups of microparticles M1-M3 differing from one another in particle size. The microparticles of the first group M1 may be smaller than the rest of the microparticles of the other groups M2, M3. The microparticles of the third group M3 may be bigger than the microparticles of the other groups M1, M2. The electric field of the sorting element 121 may be configured such that microparticles are deflected farther toward the second inner wall 25 with increasing particle size. As a result, the microparticles M1-M3 may be positioned in different columns in the microchannel 13 as illustrated in FIG. 12. The microparticles M1 with a small particle size are positioned close to the first inner wall 24. The microparticles M3 with a big particle size are deflected the farthest and positioned near the second inner wall 25. The microparticles M2 with a particle size smaller than M3 and bigger than M1 are positioned between the first group of microparticles M1 and the third group of microparticles M3.

The described sorting mechanism may be advantageous in particular for multiplexed bioassays employing beads with different sizes corresponding to different receptors on their surfaces. Different receptors may be configured for capturing different analytes, respectively, for detection and analysis.

The trapping element 122 is configured to generate an electric field for retaining the sorted microparticles at defined positions. For example, the trapping element 122 can be suited for trapping the microparticles of each group of microparticles M1-M3 in a trapping area 126-128, respectively.

The partitioning element 123 can comprise two physical walls, in particular linearly shaped solid bodies, which the microparticles M cannot penetrate. The partitioning element 123 thus prevents the sorted microparticles M1-M3 from intermixing, in particular from entering the trapping area of other groups of microparticles. Alternatively, the partitioning element 123 may comprise at least one pair of electrodes configured to generate an electric field for repelling the microparticles M. Preferably, the partitioning elements 123 may partition the microchannel 13 in equal widths, thereby allowing for a uniform fluid flow.

Figure 13:
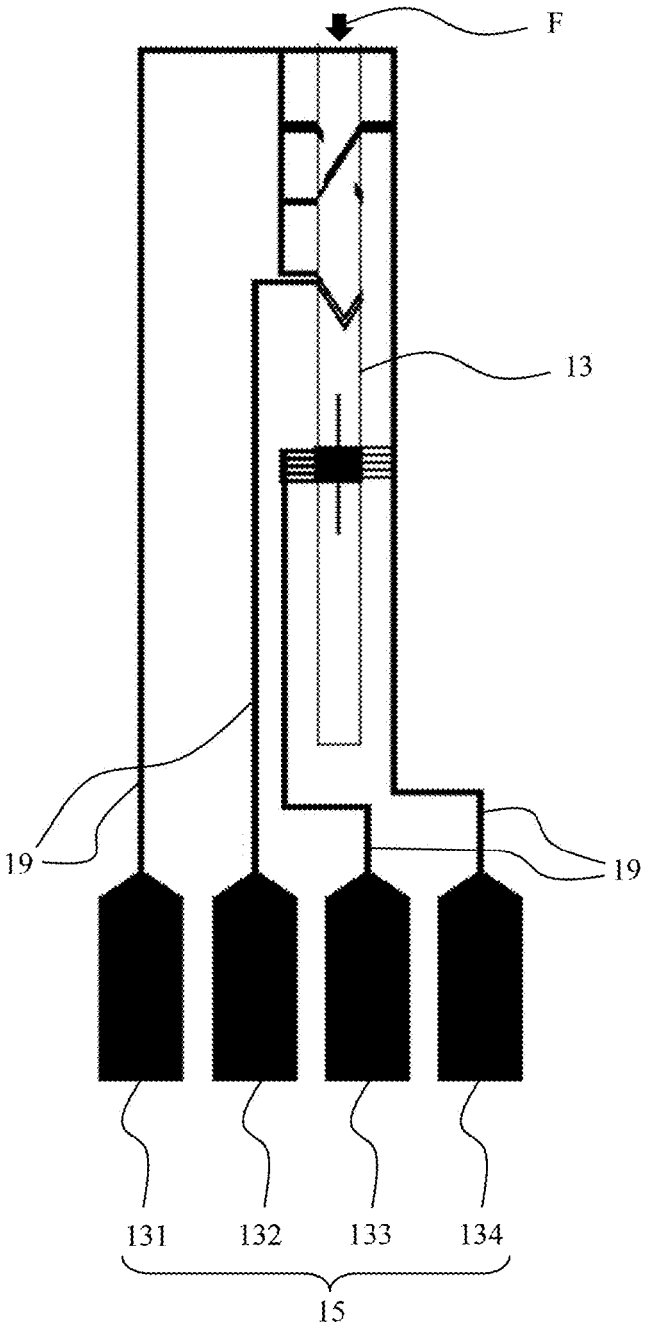
FIG. 13 shows a schematic view of an embodiment of electrical contacts for a microfluidic chip.

FIG. 13 shows a schematic view of an embodiment of electrical contacts 15 for a microfluidic chip 10.

The microfluidic chip 10 can comprise a first electrical contact 131 for operating the concentrating element 16, a second electrical contact 132 for operating the sorting element 17, a third electrical contact 133 for operating the trapping element 18 and a fourth electrical contact 134 that is a grounded contact. Preferably, the electrical contacts 131-134 are connected to an alternate current (AC) power supply. Additionally, a function generator and/or control unit may be connected to at least one of the electrical contacts 131-134 that operates and/or controls the elements and devices of the microfluidic chip. For example, the applied signal can be sinusoidal or square wave or a combination thereof.

Preferably, the elements and devices of the microfluidic chip 10 are operable and/or controllable via the electrical contacts 131-134. The sorting element 17, trapping element 18, partitioning element 23 spacing element 21 and/or concentrating element 16 may require to be electrically connected to the ground 134 and one of the other electrical contacts 131-133. Preferably, a size of electrical contacts is as small as possible in order to save manufacturing cost and required volume. Accordingly, the number of electrical contacts can be reduced by providing one single ground contact for all elements and devices of the microfluidic chip 10.

In an embodiment, the concentrating element 16, sorting element 17 and trapping element 18 may be connected to two electrical contacts each, resulting in six contacts in total. The total number of contacts may be reduced to four by sharing the ground contact and having independent counter contacts for each element.

Electrical signals applied to the electrical contacts 131-134 may have a peak-to-peak amplitude of $10^{-1}$ V to $10^{3}$ V, preferably 1 V to 100 V. A frequency applied to the electrical contacts 131-134 may be $10^{4}$ Hz-$10^{7}$ Hz, preferably $10^{5}$ Hz-$3\cdot10^{6}$ Hz.

Figure 14:
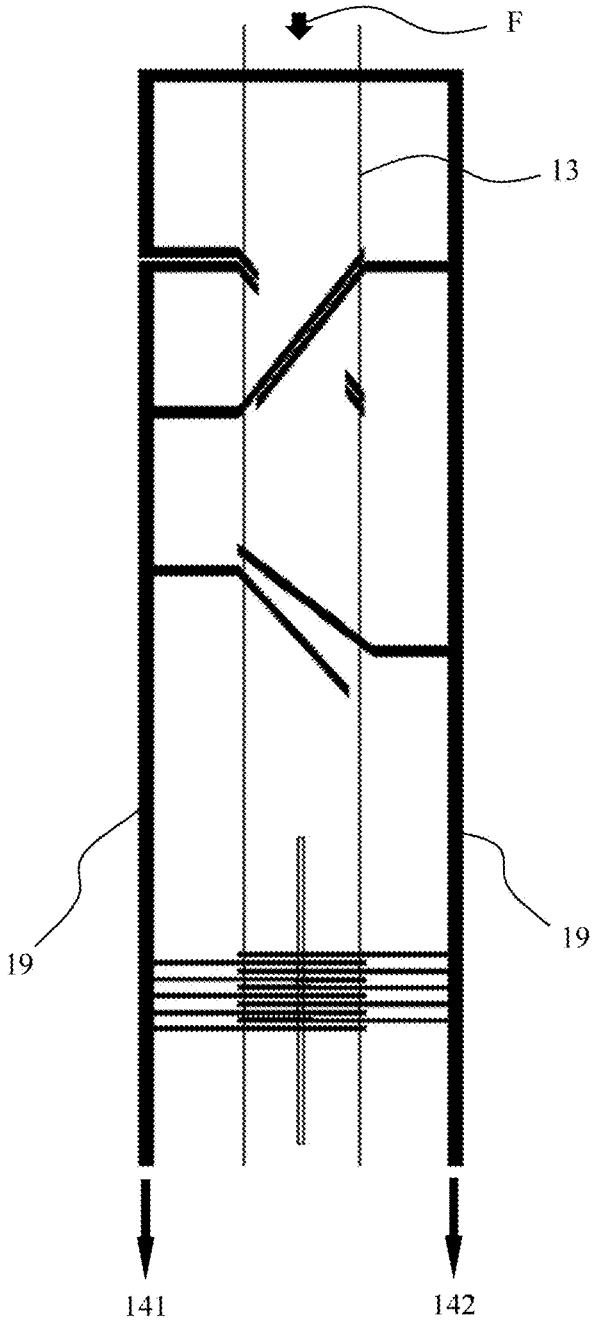
FIG. 14 shows a schematic partial view of a further embodiment of a microfluidic chip.

In a preferable further embodiment, as shown in FIG. 14, the microfluidic chip 10 may require only two electrical contacts 141, 142. The elements and devices of the microfluidic chip 10 can be tuned by adjusting the geometry, structure and arrangement of electrodes including a gap distance between two electrodes, an inclination of electrodes to the inner walls 24, 25, etc. Reduction in the number of contacts reduces chip area, thus the manufacturing costs.

Unless specified otherwise, the angles A31-A125 described above refer to angles of intersection formed by the respective electrode and the corresponding inner wall 24 or 25 inside the microchannel 13 and opening in the fluid flow direction F. In particular, the angles A31-A125 are indicated in the respective FIG. 3-FIG. 12.

The suggested microfluidic chip, microchannel or method may allow for processing microparticles, in particular beads carrying analytes, via deterministic displacement based on dielectrophoretic forces. Accordingly, the microparticles may be grouped, separated and localized in specific areas using the suggested microfluidic chip, microchannel or method. In particular, the suggested microfluidic chip, microchannel or method may prevent the microparticles from being located at unwanted positions, aggregating, adhering to surfaces of the microfluidic chip or microchannel and sedimenting. The suggested microfluidic chip or microchannel may be implemented in a microfluidic device. The suggested method may be performed using the suggested microfluidic channel or the suggested microchannel, optionally implemented in a microfluidic device.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

More generally, while the present invention has been described with reference to certain embodiments, it will be understood by those skilled in the art that various changes may be made and equivalents may be substituted without departing from the scope of the present invention. In addition, many modifications may be made to adapt a particular situation to the teachings of the present invention without departing from its scope. Therefore, it is intended that the present invention not be limited to the particular embodiments disclosed, but that the present invention will include all embodiments falling within the scope of the appended claims.

REFERENCE SIGNS

10 microfluidic chip
11 inlet port
12 capillary pump
13 microchannel
14 air vent
15 electrical contact
16 concentrating element
17 sorting element
18 trapping element
19 power line
21 spacing element
22 decelerating element
23, 23*a* partitioning element
24, 25 inner wall
26, 27 column
31, 32 electrode
33, 34 section
41, 42 electrode
51, 52 electrode
53 gap
54 pair of electrodes
55 column
61, 62 electrode
63 decelerating element
71*a*-71*d* sorting element
72*a*-72*d* concentrating element
73*a*-73*d* electrode
74*a*-74*d* electrode
75*a*-75*p* branch
76*a*-76*d* branch
77 boundary line
80 sorting element
81, 82 intermediate power line
83, 84 electrode
85 plate
86 wire
90 sorting element
91, 92 intermediate power line
$\mathbf{93}_1$-$\mathbf{93}_N$ electrode
$\mathbf{94}_1$-$\mathbf{94}_N$ electrode
96, 97 plate
101, 102 intermediate power line
103-104 electrode
105 connection wire
106-109 electrode
121 sorting element
122 trapping element
123 partitioning element
124, 125 electrode
126-128 trapping area
131-134 electrical contact
A31-A125 angle
C distance
D distance
D51, D52 gap width
D101 distance
F fluid flow, fluid flow direction
L51, L52 length
L53 gap width
M, M1-M3 microparticle(s)
w width direction
W width

What is claimed is:

1. A microchannel for processing microparticles in a fluid flow along a direction from an inlet port to an outlet port, comprising:

proximate the inlet port, a concentrating element for generating an asymmetric first electric field, oblique to the microchannel, that concentrates the microparticles into a first stream between a first inner wall of the microchannel and a midline of the microchannel;

downstream from the concentrating element, a sorting element for generating an asymmetric second electric field, oblique to the microchannel, that sorts a fraction of the microparticles from the first stream into a second stream that is nearer than the first stream to a second inner wall of the microchannel that opposes the first inner wall; and downstream from the sorting element, a trapping element extending generally across the microchannel for generating an asymmetric third electric field that traps at least a portion of the microparticles in the second stream.

2. The microchannel of claim 1, further comprising:

downstream from the sorting element, a partitioning element extending generally parallel to the midline between the first and second streams of microparticles, thereby preventing them from intermixing.

3. The microchannel of claim 1, further comprising:

upstream from the concentrating element, a spacing element protruding from the first inner wall of the microchannel for generating a repulsive electric field that pushes the microparticles away from the first inner wall of the microchannel.

4. The microchannel of claim 1, wherein the microchannel is configured to perform biological assays.

5. The microchannel of claim 3, further comprising:

downstream from the spacing element, a decelerating element protruding from the second inner wall of the microchannel.

6. The microchannel of claim 1, wherein the microchannel has a width between about $10^{-7}$ meters (m) to $10^{-4}$ m, the width referring to an extension perpendicular to the fluid flow direction.

7. The microchannel of claim 1, wherein the concentrating element has a first electrode and a second electrode, the first and second electrodes include linear portions that are arranged parallel to each other and obliquely across the microchannel, with the upstream ends of the first and second electrodes relatively closer together and the downstream ends of the first and second electrodes relatively further apart so that an electric field gradient between the first and second electrodes is less at the downstream ends thereof.

8. The microchannel of claim 1, further comprising a decelerating element protruding from the second inner wall of the microchannel downstream from the concentrating element.

9. The microchannel of claim 1, wherein the concentrating element has a plurality of first electrodes extending from the first inner wall partway across the microchannel and a plurality of second electrodes extending from the second inner wall partway across the microchannel, the first and second electrodes arranged in pairs defining electrode gaps that proceed obliquely across the microchannel from an upstream gap disposed between the midline and the second inner wall to a downstream gap disposed between the midline and the first inner wall.

10. The microchannel of claim 1, further comprising a cascade of additional concentrating elements and additional sorting elements that is formed by a plurality of first electrodes protruding obliquely upstream from the first inner wall and spaced apart along the first inner wall at first intervals;

a plurality of first branches, each protruding obliquely downstream from a corresponding one of the plurality of first electrodes;

a plurality of second electrodes, each protruding obliquely upstream from the second inner wall and closely parallel to a corresponding one of the plurality of first branches; and a plurality of second branches, each protruding obliquely downstream from a corresponding one of the plurality of second electrodes and closely parallel to a corresponding one of the plurality of first electrodes, wherein each pair of a first electrode and a second branch defines an additional concentrating element, and each pair of a first branch and a second electrode defines an additional sorting element, wherein each additional concentrating element defines a region of lesser electric field gradient substantially in registry with the first stream of microparticles, wherein each additional sorting element defines a region of lesser electric field gradient that is displaced toward the second inner wall relative to the region of lesser electric field gradient defined by the additional sorting element immediately upstream.

11. The microchannel of claim 10, wherein a concentrator gap between the second branches and the respective first electrodes is smaller than a sorter gap between the first branches and the respective second electrodes.

12. The microchannel of claim 1, wherein the sorting element comprises:

a plurality of first electrodes extending generally across the microchannel, each of the first electrodes including a plurality of plates connected to another by a wire; and a plurality of second electrodes extending generally across the microchannel and interdigitated with the plurality of first electrodes, each of the second electrodes including a plurality of plates connected to another by a wire, wherein the plates of the first and second electrodes are arranged to produce the second asymmetric electric field by laterally offsetting the plates of the second electrodes from adjacent plates of the first electrodes.

13. The microchannel of claim 1, wherein the sorting element comprises:

a plurality of first electrodes extending generally across the microchannel, each of the first electrodes including a plurality of triangular plates; and a plurality of second electrodes extending generally across the microchannel and interdigitated with the plurality of first electrodes, each of the second electrodes including a plurality of triangular plates that complement the triangular plates of the plurality of first electrodes, wherein the plates of the first and second electrodes are arranged to produce the second asymmetric electric field by varying the distances between the complementary plates.

14. A microfluidic chip, comprising:

an inlet port;

a pump; and a microchannel for processing microparticles in a fluid flow along a direction from the inlet port to the pump, the microchannel fluidly connecting the inlet port and the pump, the microchannel in turn comprising:

proximate the inlet port, concentrating element for generating an asymmetric first electric field, oblique to the microchannel, that concentrates the microparticles into a first stream between a first inner wall of the microchannel and a midline of the microchannel;

downstream from the concentrating element, sorting element for generating an asymmetric second electric field, oblique to the microchannel, that sorts a fraction of the microparticles from the first stream into a second stream that is nearer than the first stream to a second inner wall of the microchannel that opposes the first inner wall; and downstream from the sorting element, a trapping element extending generally across the microchannel for generating an asymmetric third electric field that traps at least a portion of the microparticles in the second stream.

15. The microfluidic chip of claim 14, further comprising:

downstream from the sorting element, a partitioning element extending generally parallel to the midline between the first and second streams of microparticles, thereby preventing them from intermixing.

16. The microfluidic chip of claim 14, wherein the concentrating element has a first electrode and a second electrode, the first and second electrodes include linear portions that are arranged obliquely across the microchannel, with the upstream ends of the first and second electrodes relatively closer together and the downstream ends of the first and second electrodes relatively further apart so that an electrical field gradient between the first and second electrodes is less at the downstream ends thereof.

17. The microfluidic chip of claim 14, wherein the concentrating element has a plurality of first electrodes extending from the first inner wall partway across the microchannel and a plurality of second electrodes extending from the second inner wall partway across the microchannel, the first and second electrodes arranged in pairs defining electrode gaps that proceed obliquely across the microchannel from an upstream gap disposed between the midline and the second inner wall to a downstream gap disposed between the midline and the first inner wall.

18. The microfluidic chip of claim 14, further comprising a cascade of additional concentrating elements and additional sorting elements that is formed by a plurality of first electrodes protruding obliquely upstream from the first inner wall and spaced apart along the first inner wall at first intervals;

a plurality of first branches, each protruding obliquely downstream from a corresponding one of the plurality of first electrodes;

a plurality of second electrodes, each protruding obliquely upstream from the second inner wall and closely parallel to a corresponding one of the plurality of first branches; and a plurality of second branches, each protruding obliquely downstream from a corresponding one of the plurality of second electrodes and closely parallel to a corresponding one of the plurality of first electrodes, wherein each pair of a first electrode and a second branch defines an additional concentrating element, and each pair of a first branch and a second electrode defines an additional sorting element, wherein each additional concentrating element defines a region of lesser electric field gradient substantially in registry with the first stream of microparticles, wherein each additional sorting element defines a region of lesser electric field gradient that is displaced toward the second inner wall relative to the region of lesser electric field gradient that is defined by the additional sorting element immediately upstream.

19. A method for arranging microparticles in a fluid flow in a microchannel, comprising:

concentrating the microparticles into a first stream between a midline of the microchannel and a first inner wall of the microchannel by generating, at a concentrating element, a first asymmetric electric field that extends obliquely across the microchannel;

sorting a fraction of the microparticles from the first stream into a second stream that is nearer to the second inner wall than the first stream, by generating, at a sorting element downstream from the concentrating element, a second asymmetric electric field that extends obliquely across the microchannel; and trapping at least some of the sorted microparticles by generating a third asymmetric electric field at a trapping element that extends across the microchannel downstream from the sorting element.

20. The method of claim 19, further comprising:

partitioning the second stream of microparticles from the first stream of microparticles by generating a repulsive electric field along a partitioning element that extends generally parallel to the midline downstream from the sorting element.

* * * * *